US011578874B2

(12) United States Patent
Hatchett

(10) Patent No.: US 11,578,874 B2
(45) Date of Patent: Feb. 14, 2023

(54) COOKING APPLIANCE WITH CONTROL HOUSING SPILL CONTROL SUPPORT

(71) Applicant: Electrolux Home Products, Inc., Charlotte, NC (US)

(72) Inventor: Houston Hatchett, Springfield, TN (US)

(73) Assignee: Electrolux Home Products, Inc., Charlotte, NC (US)

( * ) Notice: Subject to any disclaimer, the term of this patent is extended or adjusted under 35 U.S.C. 154(b) by 300 days.

(21) Appl. No.: 16/918,573

(22) Filed: Jul. 1, 2020

(65) Prior Publication Data

US 2022/0003424 A1 Jan. 6, 2022

(51) Int. Cl.

| | |
|---|---|
| ***F24C 15/08*** | (2006.01) |
| ***F24C 7/08*** | (2006.01) |
| ***F24C 3/12*** | (2006.01) |
| ***F24C 15/14*** | (2006.01) |

(52) U.S. Cl.

CPC ..... *F24C 15/08* (2013.01); *F24C 3/124* (2013.01); *F24C 7/082* (2013.01); *F24C 15/14* (2013.01)

(58) Field of Classification Search

CPC ..... F24C 15/08; F24C 3/124; F24C 15/14; F24C 7/082; F24C 15/12; F23C 15/10

USPC ..... 126/383.1, 384.1, 385.1, 51; 312/31.06, 312/229; 220/571; 248/200, 201, 248/220.21, 220.22, 248, 224.51, 247, 248/300; 361/627, 649, 807, 810

See application file for complete search history.

(56) References Cited

U.S. PATENT DOCUMENTS

| | | | | |
|---|---|---|---|---|
| 3,509,605 | A * | 5/1970 | More | F24C 7/082 126/211 |
| 3,877,457 | A * | 4/1975 | Doner | F24C 3/124 219/457.1 |
| 5,375,921 | A * | 12/1994 | Tupa | F24C 7/082 312/257.1 |
| 6,103,338 | A | 8/2000 | Gille et al. | |
| 10,376,098 | B2 * | 8/2019 | Chun | F24C 15/08 |
| 10,935,247 | B2 * | 3/2021 | Kim | F24C 3/126 |

(Continued)

FOREIGN PATENT DOCUMENTS

| | | |
|---|---|---|
| CN | 201377833 | 1/2010 |
| CN | 203385037 | 1/2014 |

(Continued)

*Primary Examiner* — David J Laux
(74) *Attorney, Agent, or Firm* — Pearne & Gordon LLP

(57) ABSTRACT

A household appliance is provided having a cooktop with a control housing disposed at an outer peripheral edge of the cooktop. A control panel of the control housing is configured to allow a user to control the cooktop and is least partially housed within the control housing. A support member is interposed at least partially between the cooktop and the control housing and includes a gutter adapted to direct fluids from the cooktop away from electrical or electronic elements housed within the control housing, such as the control panel. The support member can be coupled to or otherwise support the control housing, such as to assure appropriate alignment thereof, such as for automated assembly. The support member further can be hidden from view of a user beneath respective upper surfaces of the control housing and the cooktop, allowing these upper surfaces to lie co-planarly, providing a desirable aesthetic.

19 Claims, 10 Drawing Sheets

(56) References Cited

U.S. PATENT DOCUMENTS

| | | | | |
|---|---|---|---|---|
| 2009/0296371 | A1* | 12/2009 | Desmet | F24C 7/082<br>362/85 |
| 2011/0290783 | A1* | 12/2011 | Geiger | F24C 15/10<br>248/224.8 |
| 2014/0150772 | A1* | 6/2014 | Fockler | F24C 3/126<br>126/39 E |
| 2016/0045025 | A1* | 2/2016 | Trunkle | F16M 13/02<br>248/231.91 |
| 2016/0187000 | A1* | 6/2016 | Jang | F24C 7/083<br>126/39 B |
| 2019/0313847 | A1* | 10/2019 | Chun | F24C 15/08 |
| 2020/0271326 | A1* | 8/2020 | Kozinski | F24C 3/124 |

FOREIGN PATENT DOCUMENTS

| | | | | |
|---|---|---|---|---|
| CN | 205641023 | | 10/2016 | |
| CN | 205842760 | | 12/2016 | |
| CN | 207112903 | | 3/2018 | |
| CN | 111067374 | A * | 4/2020 | A47J 37/0664 |
| EP | 2634494 | | 9/2013 | |

* cited by examiner

COOKING APPLIANCE WITH CONTROL HOUSING SPILL CONTROL SUPPORT

FIELD OF THE INVENTION

The present disclosure is directed to a support member for aligning a control housing of a household appliance, and more specifically to a support member including a gutter assembly for diverting flow of fluids, such as spilled fluids, away from contact with electronic controls arranged at the control housing.

BACKGROUND

Conventionally, household appliances, such as cooking appliances, include a frame or chassis supporting functional elements and providing a general shape of the appliance. Decorative external body panels are attached to the frame or chassis to enclose the functional elements and provide the resultant outer appearance and footprint for the appliance. While the external panels typically provide little or no structural support to the appliance, one or more of the panels, and/or an element of the frame or chassis, typically supports a control housing having electronic controls for controlling operation of the appliance.

In front-control cooking appliances, it is important to keep fluids such as spills from the sensitive electronic components of the electronic controls. Conventionally, this can be done by aligning the respective cooktop beneath a top surface of the control housing. In this way, spills at the cooktop remain on the cooktop, though at an elevation below that of an uppermost aspect of the control panel housing. As such, spills can be directed away from flowing into the control panel housing. This arrangement, however, prevents a cooking appliance design having surface-planar abutment between the control housing and the cooktop, thereby limiting available aesthetic design.

In other conventional front-control cooking appliances, such spills are kept from sensitive electronic components either by placing those components well forward of the control housing-cooktop interface, or by use of a pliable interface, such as a gasket, disposed at the control housing-cooktop interface. The required distancing or the need for the gasket limits available aesthetic design of these cooking appliances. Additionally, the gasket is susceptible to failure and/or can require being made of an expensive material that will not quickly fail in close proximity to high heat.

BRIEF SUMMARY

According to one aspect, a cooking appliance includes cooktop, a control housing disposed adjacent to the cooktop and housing an electronic control, and a support member interposed at least partially between the cooktop and the control housing. The support member has a gutter adapted to direct fluids from the cooktop away from the electronic control, wherein the control housing is aligned relative to the cooktop via a plurality of guides of the support member.

According to another aspect, a cooking appliance includes a cooktop, a cooktop having a cooktop surface, and a control housing disposed adjacent to the cooktop and housing one or more electronic controls, such that the cooktop surface is substantially coplanar with an upper surface of the control housing and defines a gap therebetween. A support member is configured to redirect fluids penetrating the gap from the cooktop away from the one or more electronic controls. The support member is interposed at least partially between the cooktop and the control housing, and supports the control housing to align the upper surface of the control housing in substantially the same plane as the cooktop surface.

According to yet another aspect, a support member for supporting a control housing of a cooking appliance adjacent to a cooktop of the cooking appliance is addressed. The support member includes a cross member, a pair of legs extending vertically from opposite ends of the cross member, and a gutter extending along the cross member at a first side thereof. An upper support flange extends from a second side of the cross member opposite the first side thereof. The upper support flange is configured to support an upper wall of a control housing in order to align and install the control housing to said appliance. The gutter defines a channel for receiving fluid therein and for diverting said fluid laterally outwardly in the channel.

The foregoing and other features of the invention are hereinafter described in greater detail with reference to the accompany drawings.

BRIEF DESCRIPTION OF THE DRAWINGS

The accompanying drawings, which are not necessarily to scale, show various aspects of the disclosure.

DETAILED DESCRIPTION

The present disclosure addresses the alignment and arrangement of a cooktop in a front-control cooking appliance, relative to an adjacent control housing for housing cooktop controls. Generally, the cooking appliance of the present disclosure includes a support member that both supports a control housing and restricts or altogether prevents spills from contacting the sensitive electrical aspects or other components of electronic controls within the control housing, which controls can be affected by contact with moisture.

Use of the support member allows upper surfaces of the cooktop and control housing to be arranged substantially co-planar, providing a desirable aesthetic for the user. The support member is adapted to redirect any spills that may leak through a seam (also herein referred to as a gap) between the cooktop and the control housing, without the need for a gasket disposed between the cooktop and the control housing, and without the need for the cooktop surface to be tucked or extended beneath the control housing at a lower elevation than the upper surface of the control housing.

Particularly, the support member and the cooktop-control housing arrangement described herein are suitable for use in a household or commercial cooking appliance, such as a free-standing or a slide in oven. Additionally, the support member and arrangement also are suitable for a stand-alone range top or a countertop cooking appliance having a control panel located at its front. Likewise, other kitchen appliances also can benefit from a support member that aids in directing spills away from sensitive electronics while also allowing aesthetic arrangement of a respective control housing and upper surface (such as a cooktop surface) of the kitchen appliance. The support member also is suitable for use in directing spills away from non-electric components that may be sensitive to moisture, such as metal components of a gas valve or components having lubricant disposed thereon.

Figure 1:
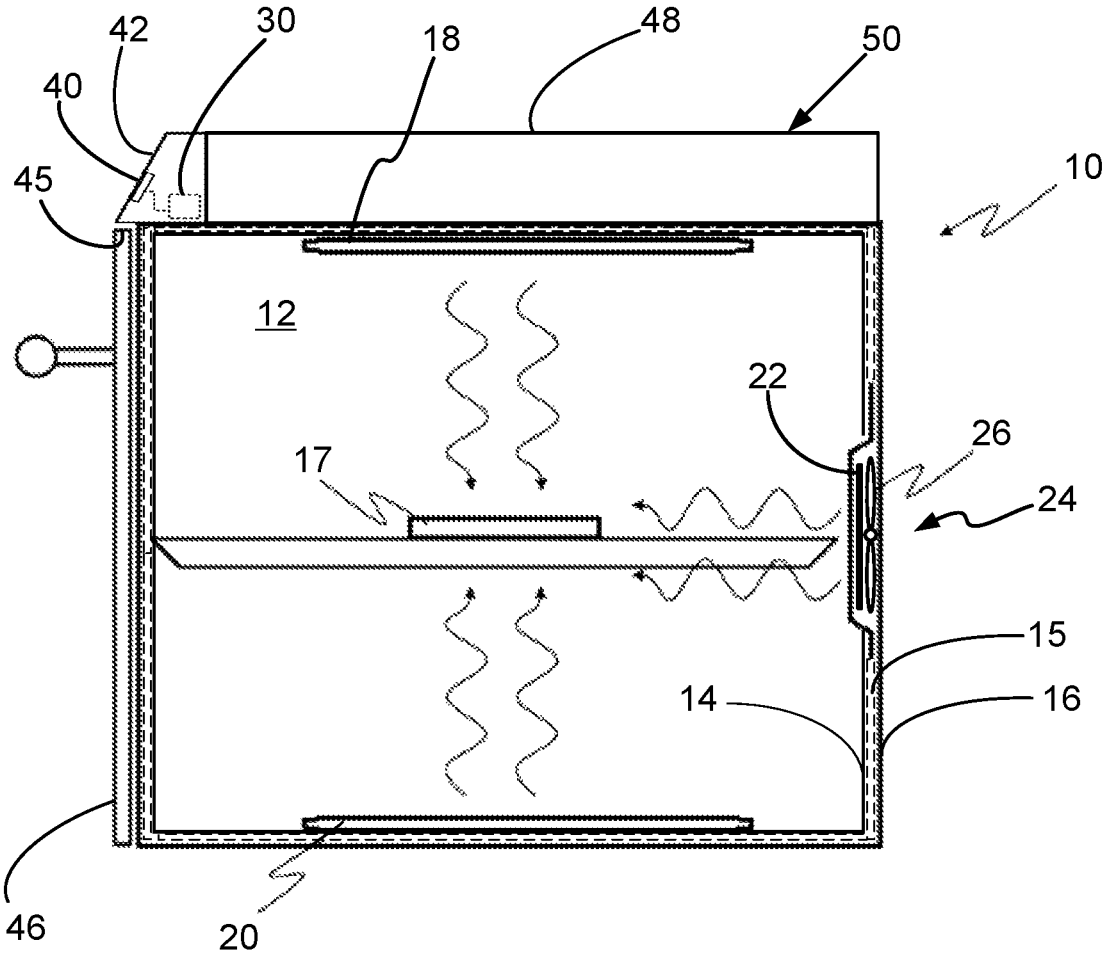
FIG. 1 schematically illustrates a side cross-section of a front control cooking appliance that can include a support member according to the present disclosure for supporting the front control housing.

Turning now to FIG. 1, a household appliance 10, such as a household kitchen range or other cooking appliance, is schematically illustrated having a fan and heating elements for heating an interior oven cavity 12 defined by an oven muffle 14. The muffle 14 is mounted to and supported by an appliance chassis 15 as known in the art. The appliance chassis 15 can support a decorative external body 16 to provide the appliance's outward appearance.

A food item 17 to be cooked is illustrated within the oven cavity 12. The heating elements for heating the oven cavity 12 and for cooking the food item 17 can include one or more of a broil heating element 18, a bake heating element 20, and a convection heating element 22. The broil heating element 18 is disposed at (i.e., in or adjacent) an upper portion of the oven cavity 12. The bake heating element 20 is disposed at (i.e., in or adjacent) a lower portion of the oven cavity 12, generally opposite the broil heat element 18. The convection heating element 22 is disposed at (i.e., in or adjacent) a back portion of the oven cavity 12.

The convection heating element 22 is part of a convection heating system 24 including the convection heating element 22 and an associated motive element for moving heated air, such as convection fan 26.

One or more additional heating elements or fans can be provided in other embodiments, and/or one or more of them can be omitted. For example, the oven cavity 12 can be heated by induction heating elements and/or microwave heating elements in other embodiments.

Figure 2:
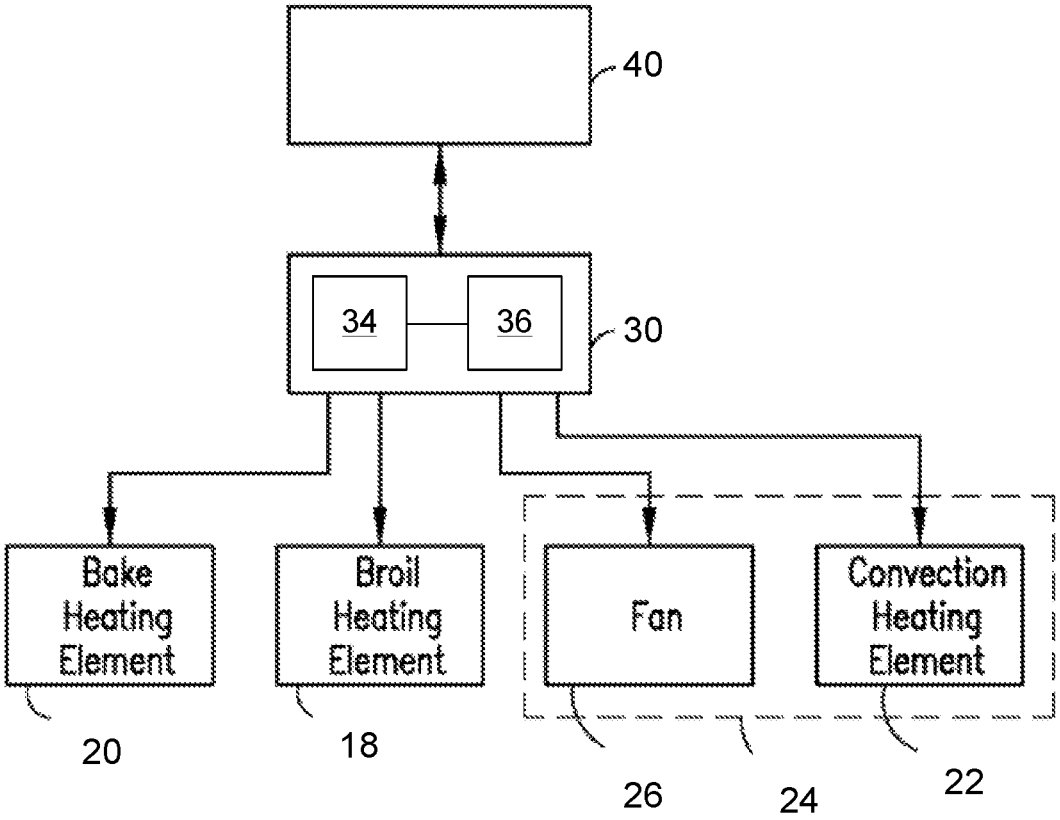
FIG. 2 schematically illustrates a control system of the cooking appliance of FIG. 1.

The cooking appliance 10 includes a control system 30, which while illustrated at an upper-forward location of the appliance 10 can be otherwise suitably located in other embodiments. The control system 30 is schematically illustrated at FIG. 2 and is provided for controlling operation of the heating elements 18, 20 and 22 and of the fan 26. As will be understood by one having ordinary skill in the art, the control system 30 of the cooking appliance 10 can be configured to operate any one of the heating elements 18, 20 and 22 and of the fan 26 separately from one another or in conjunction with any one or more of the other of the heating elements 18, 20 and 22 and of the fan 26. The control system 30 includes at least a processor 34 and a storage 36, such as a memory, which in other embodiments can be integral with the processor 34.

Still looking to FIG. 1, a user can control aspects of the cooking appliance 10 via a user control interface 40 communicatively coupled to the control system 30. The control interface 40 is illustrated arranged, such as at least partially received within, a control housing 42. The control system 30 also is shown disposed within the control housing 42. But this is not required, and control system 30 can be arranged at an alternative location of the cooking appliance 10 in other embodiments and remain in operative communication with control elements of the user control interface 40.

The control housing 42 is disposed at a forward location of the cooking appliance 10, providing easy-to-reach access to the control interface 40 for a user. A front portion of the control housing 42 can be disposed adjacent and over a top surface 45 of a door 46 of the oven cavity 12. In other embodiments, the control housing 42 may instead extend less far forward, e.g. it may be recessed rearward of the top surface 45 of the door 46.

One or more electronic controls of the control panel 40 can enable control of cooking cycles within the oven cavity 12 and/or of a respective cooktop 48. The illustrated cooktop 48 is arranged above the oven cavity 12, supported by the chassis 15, and rearward of the control housing 42. The cooktop 48 can heat cooking utensils for cooking food on the cooktop surface 50 by any one or more of gas heating elements, electric heating elements or induction heating elements as known in the art.

Figure 3:
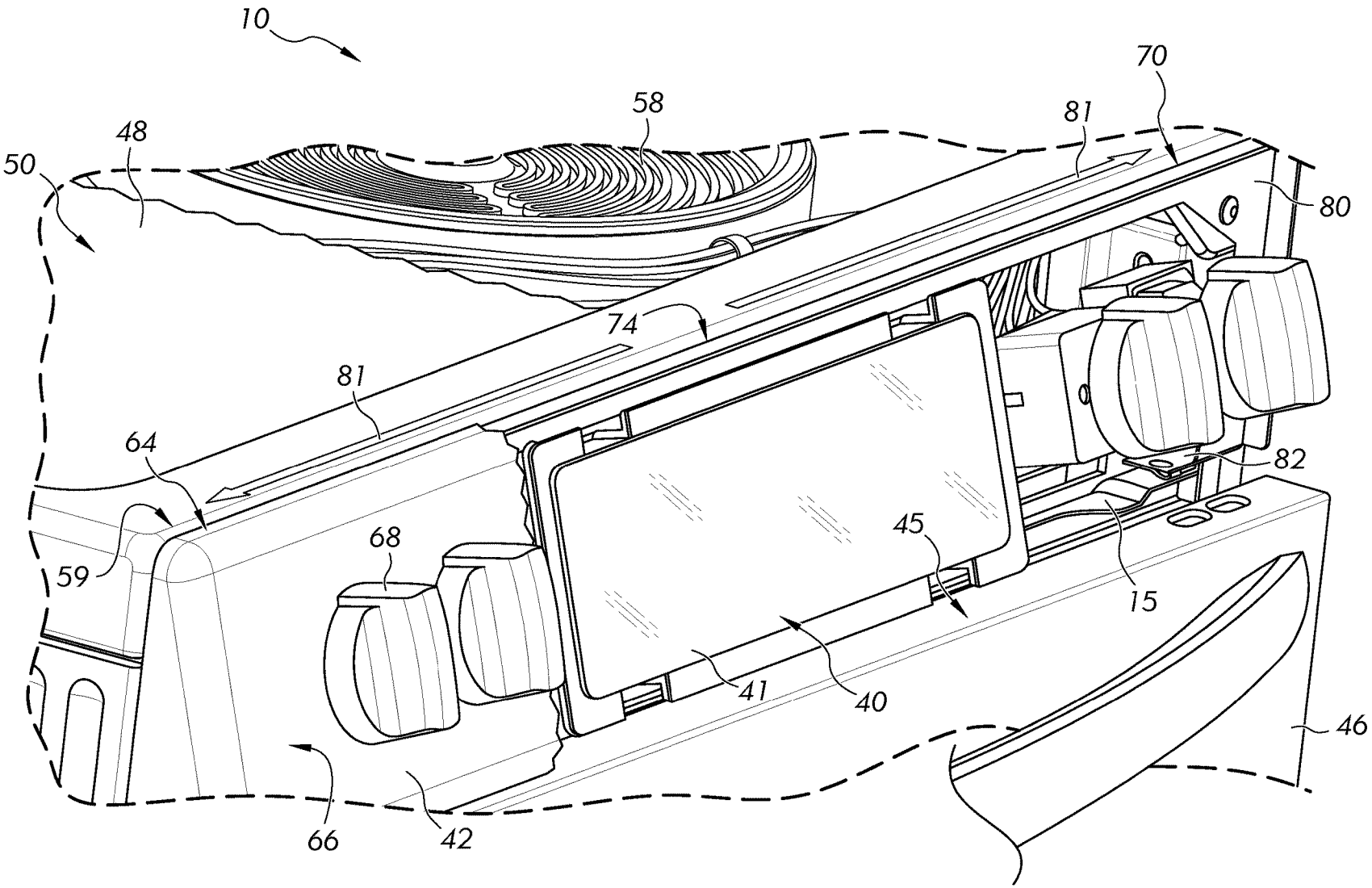
FIG. 3 illustrates a detailed front perspective view of a portion of the cooking appliance of FIG. 1, with the control housing partially broken away to reveal underlying features.
Figure 4:
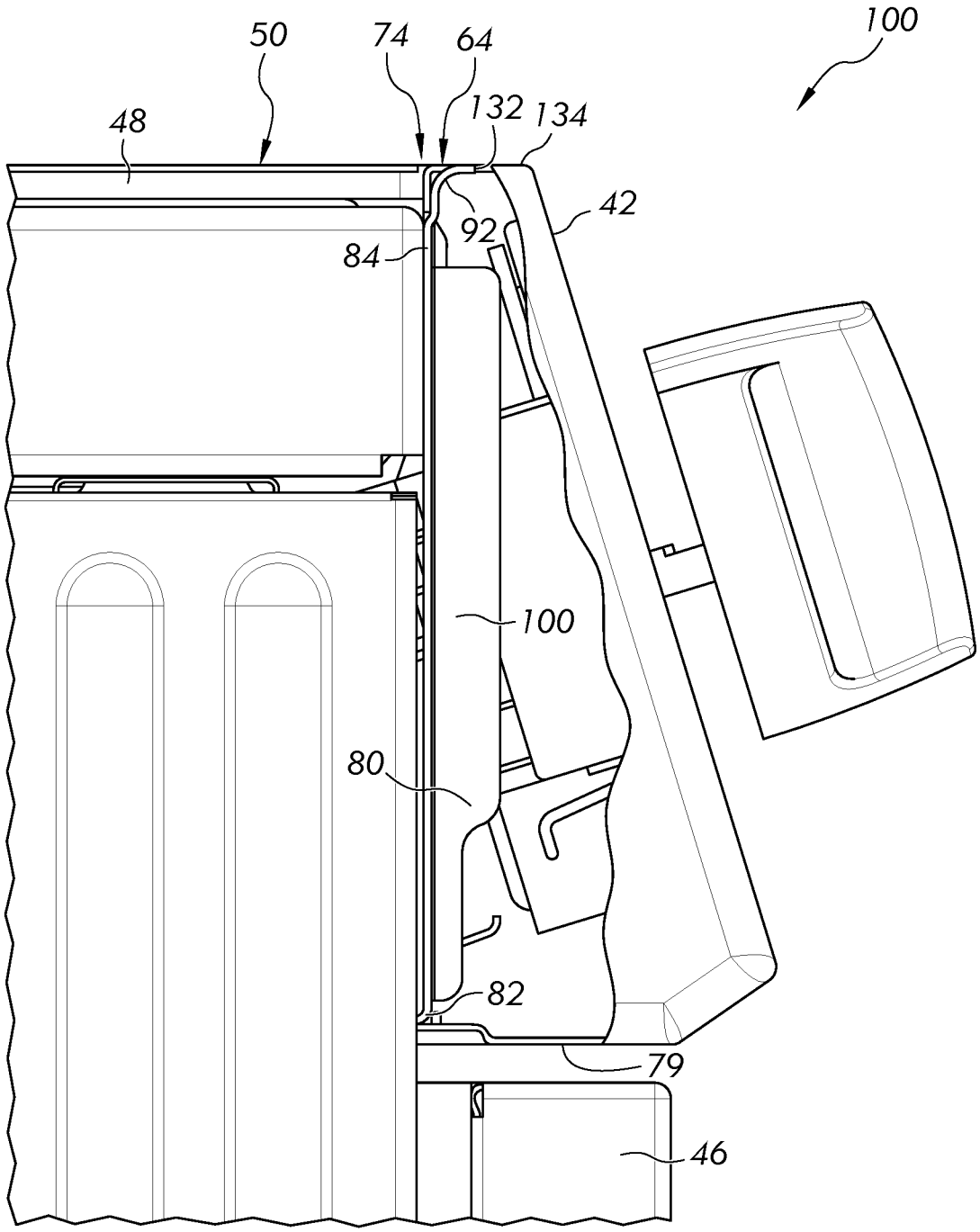
FIG. 4 illustrates a partial side view of the cooking appliance of FIG. 1, with the control housing partially broken away.

Turning now to FIGS. 3 and 4, a front view of the cooking appliance of FIG. 1 is illustrated in detail at FIG. 3, while side view of the cooking appliance is depicted at FIG. 4. At each of FIGS. 3 and 4, the control housing 42 is partially broken away to allow for viewing of subjacent features.

As illustrated, the cooktop 48 includes an upper cooktop surface 50 that also is partially broken away to allow for viewing of subjacent features. The cooktop 48 includes a plurality of electrically-activated heating elements 58 (induction heating elements are shown but other known heating elements can be used) located beneath the cooktop surface 50. For conventional radiant cooktops, the cooktop surface is a smooth sheet of glass or ceramic that presents a smooth, flat appearance, on which cooking utensils directly rest. The cooktop surface 50 generally terminates at a laterally extending front edge 59 adjacent to where it meets the upper surface of the control housing 42.

As indicated, the control housing 42 is disposed adjacent the cooktop 48 and at a front of the appliance 10. The control housing 42 can extend over the top surface 45 of the door 46 as discussed above, when the door 46 is in a closed orientation seated against the chassis 15.

The control housing 42 encloses and/or supports electronic control elements for controlling one or more features of the appliance 10. It also may house the control system 30, as noted above. The control housing in the illustrated embodiment includes a top surface 64 and a front surface 66. As shown, a plurality of control elements, such as activation knobs 68 and a control panel 40 (which can be or include a touch-screen interface 41) are provided (e.g. extending above or substantially co-planar with) the front surface 66. In this embodiment, the front surface 66 of the control housing 42 is angled in order to provide an aesthetic appearance, and also to ease user-access to control elements provided therein. But the front surface 66 need not be angled, and it can be orthogonal to the top surface 64 of the housing 42 in other embodiments. The activation knobs 68 and/or panel 40 can control any of the cooktop 48 and/or heating elements for the oven cavity 12 (FIG. 1) in a conventional manner.

As illustrated, the control housing 42 is disposed directly adjacent, such as abutting, the cooktop 48, preferably so that the top surface 64 of the control housing 42 extends along the front edge 59 of the cooktop surface 50, preferably in face-to-face adjacency therewith and defining a seam therebetween. With the control housing 42 and the cooktop 48 so arranged, the top surface 64 of the control housing and the cooktop surface 50 are disposed substantially co-planar with one another, separated by the aforementioned seam. Notably, however, the cooktop 48 and the control housing 42 typically are not sealed to one another along the aforementioned seam, such that the front edge 59 of the cooktop surface 50 remains discontinuous with the top surface of control housing 42. Indeed, one or both of the front edge 59 of the cooktop surface 50 and a rear edge 70 of the top surface 64 of the control housing 42 can be rounded or beveled; e.g. during manufacturing the appliance or even to the consumer in the field. As a result, the aforementioned seam between these edges yields a gap 74 that remains between the top surface 64 of the control housing 42 and the cooktop surface 50 through which liquids otherwise might penetrate in case of cooktop spills.

Interposed between the cooktop 48 and the control housing 42, and located at least partially under or within the control housing 42, is a support member 80, which generally helps support the control housing 42 from beneath its top surface 64. In addition, in the disclosed embodiments it is configured to protect electronic controls or other electronic components or circuits within the control housing 42, against liquids spilled at the cooktop 48 that might otherwise penetrate the gap 74 and reach those components. Specifically, the support member 80 is configured with a fluid retention and redirection element for redirecting such spills in laterally-outward directions 81, away from electronic controls and toward lateral sides of the appliance. Additional aspects of the support member 80 providing these features are detailed below.

As illustrated at FIGS. 3 and 4, a lower portion of the support member 80, such as a lower mounting flange 82, is coupled to the chassis 15, such as at an upper surface of a front portion of the chassis 15. Particularly, a lower portion 79 of the control housing 42, the mounting flange 82 and the chassis 15 are coupled to one another, with the lower portion 79 of the control housing 42 disposed below the mounting flange 82. In other embodiments, the lower portion 79 of the control housing 42 can be otherwise coupled relative to the chassis 15 and/or the support member 80.

Figure 5:
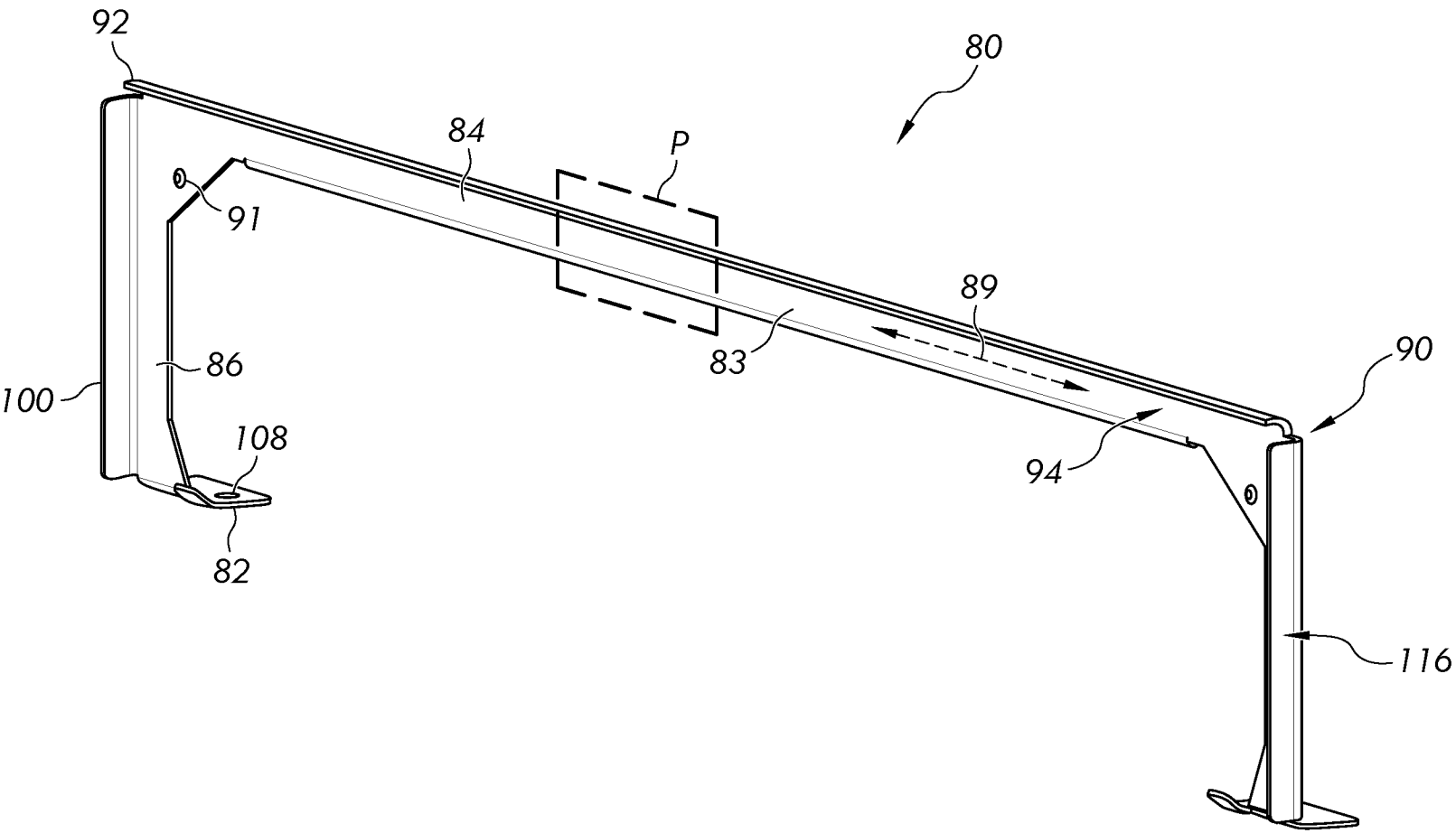
FIG. 5 illustrates a first front perspective view of an example support member as disclosed herein.
Figure 6:
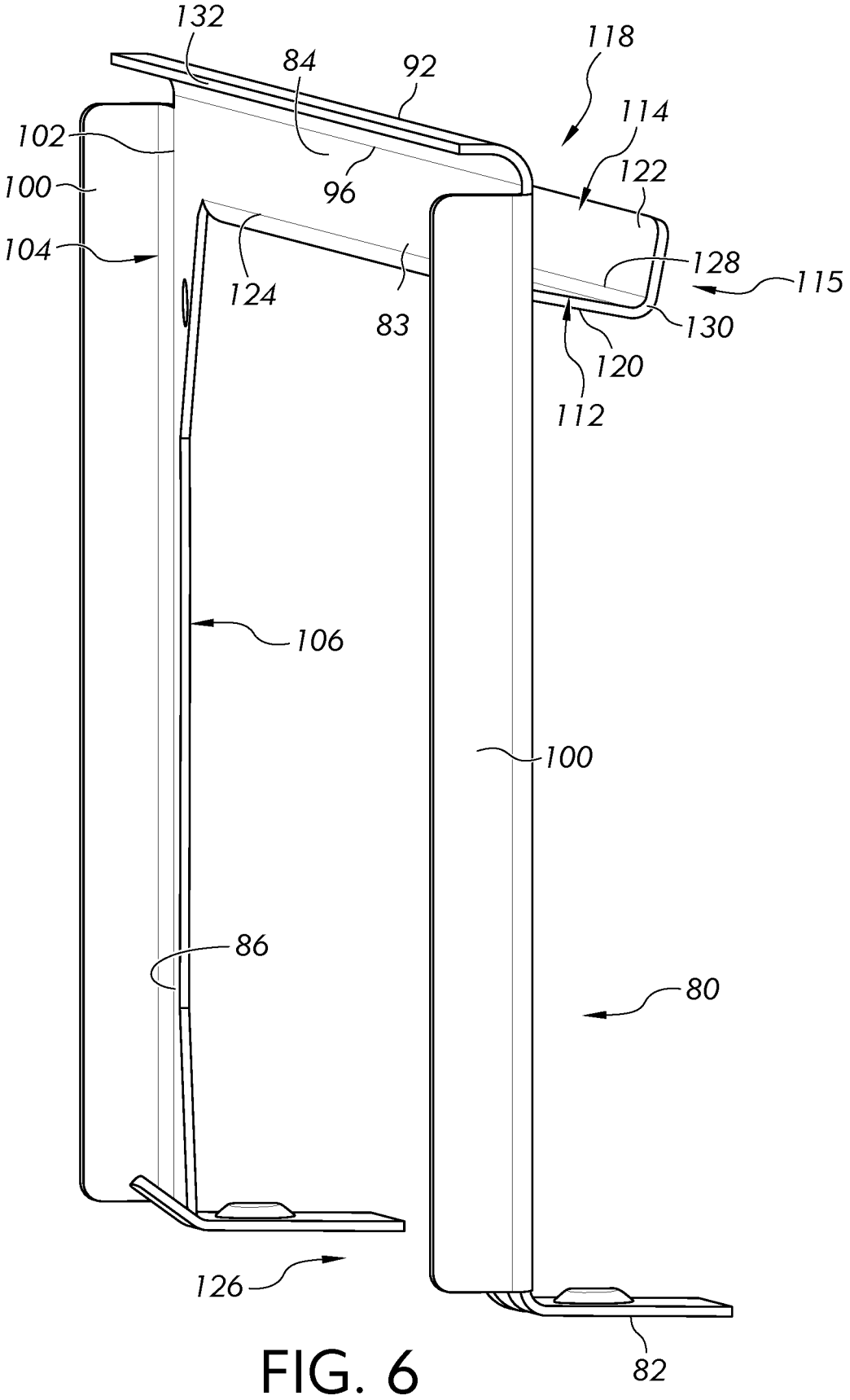
FIG. 6 illustrates a second front perspective view of the support member of FIG. 5.

Turning now to FIGS. 5 and 6, an embodiment of the support member 80 will be described in detail. As depicted, the support member 80 is formed from a single unitary sheet of metal, such as aluminum or steel. The sheet is cut, bent and/or stamped to form the various illustrated features of the support member 80, which are integral with one another. In other embodiments, one or more aspects of the support member 80 can be affixed to a central body 83 of the support member 80, such as by fasteners, welding, etc.

The depicted support member 80 includes the central body 83 having a horizontally-extending upper cross member 84 and a pair of vertically-extending legs 86 extending from opposite lateral ends 90 of the cross member 84. The legs 86 and the cross member 84 each extend generally within a common plane P of the central body 83. The cross member 84 extends along a lateral axis 89 and includes one or more mounting holes 91 to facilitate fastening the cross member 84 relative to the cooktop 48 and the control housing 42. The legs 86 extend generally orthogonally to the lateral axis 89, within the plane P.

As used herein, horizontal and vertical directions are with respect to the appliance 10 in a typical upright orientation seated atop a support surface, such as a floor. In other embodiments, any one or both of the legs 86 can extend at any suitable angle from the cross member 84; additional legs 86 can be included; additional legs 86 or one or more of the depicted pair of legs 86 can extend from an alternative location along the cross member 84.

An upper support flange 92 extends in a forward direction outwardly from a front face 94 of the central body 83. The illustrated upper flange 92 arcs both upwardly and outwardly (forward) from the cross member 84. The upper flange 92 is generally bent outwardly from a top end of the cross member 84 beginning from a laterally-extending horizontal bend line 96 (FIG. 6). That is, the flange 92 depends from an upper edge of the cross member 84, essentially forming an extension thereof that is bent about a horizontal axis along an arc until reaching its terminal end along a substantially horizontal tangent plane. In other embodiments, a discrete delineation between the cross member 84 and the upper flange 92 (e.g. bend line 96) may not be present and can be omitted.

A side flange 100 extends from each leg 86, in a direction outwardly (forward) from the front face 94 thereof. The side flanges 100 each extend from respective laterally-outer ends of the opposing legs 86 and are disposed in planes generally orthogonal to the plane P. Particularly, the side flanges 100 can be provided as extensions of the respective legs 86, bent along a vertically-extending bend line 102 in each (e.g. about a respective vertical axis if following an arcuate path) from the respective leg 86, each forming a tapered bend portion 104. As shown, the side flanges 100 provide the laterally-outer bounds of the support member 80 and also provide rigidity for the support member 80 against bending of the central body 83 out of the plane P.

A lower mounting flange 82 extends from a lower end of each of the legs 86 in horizontal plane, preferably extending in a rearward direction from a rear face 106 of the central body 83, each forming a tapered bend portion 108. The lower mounting flanges 82 each are disposed in a plane (preferably a common plane) generally orthogonal to the plane P. Each of these lower mounting flanges 82 includes at least one mounting hole 108 for aiding in fixing the support member 80 relative to the cooktop 48 and the control housing 42. In other embodiments, the lower mounting flanges 82 optionally can extend in a direction forward from the front face 94.

Turning specifically to FIG. 6, a fluid gutter 112 is disposed at a rearward side 118 of the support member 80; the rearward side has the rear face 106 of the central body 83. The gutter 112 is disposed vertically below the upper support flange 92 and is configured to catch liquids dripping from the cooktop-control housing interface, as will be further explained. The illustrated gutter 112 is generally U-shaped, defining a laterally-extending channel 114. The channel 114 extends between opposed gutter ends 115 adjacent to the respective-laterally-outer ends 116 (FIG. 5) of the support member 80. Preferably, the gutter 112 extends along substantially a full lateral extent of the cross member 84, between the side flanges 100.

The U-shaped gutter 112 is formed by a bent metal flange formed with (i.e. as part of) or otherwise attached to and cantilevered from the cross member 84, preferably at or from a bottom portion thereof opposite that from where the upper support flange 92 extends or is attached. The gutter 112 includes a gutter floor 120 and a rear gutter wall 122, preferably formed integrally and joined at a bend line therebetween. That is, the gutter floor 120 can extend rearward from rear face 106 of cross member 84, e.g. formed as a metal bending beginning along a laterally-extending bend line 124, and continuing along an arcuate bend portion 126 until reaching a planar portion of the gutter floor 120. As depicted, the gutter floor 120 can be angled downward from a respective horizontal plane as it extends rearwardly from the rear face 106 of cross member 84. This facilitates rearward flow of any fluid dripped into the gutter 112, away from the forward side 126 of the support member 80.

Figure 7:
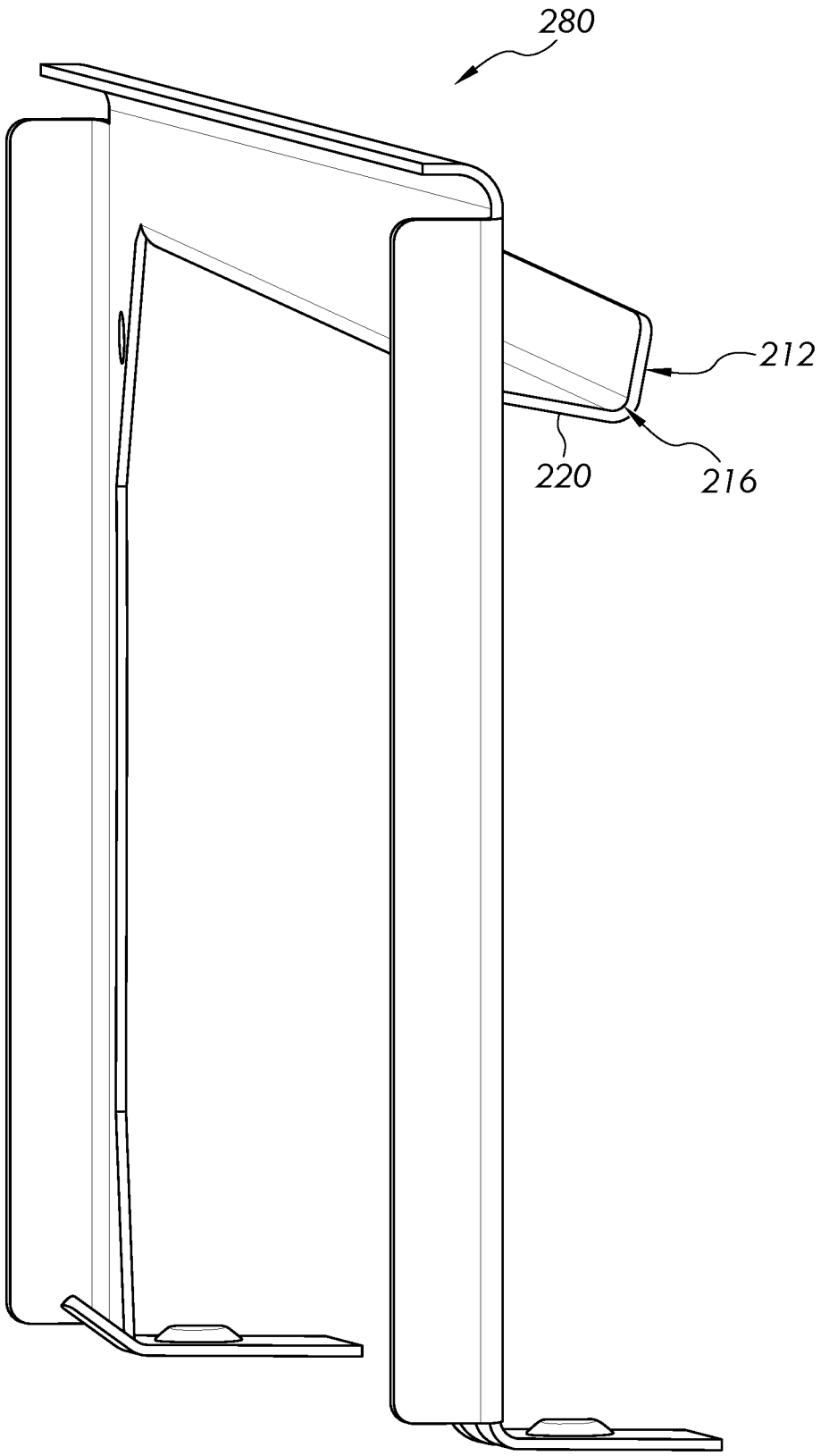
FIG. 7 illustrates a front perspective view of another example support member according to the present disclosure, this support member having the gutter floor arranged differently than that of the support member of FIG. 6.

The rear gutter wall 122 extends upwardly from a rear portion of the gutter floor 120, preferably formed as a metal bend therefrom beginning at another laterally-extending bend line 128, and continuing along arcuate bend portion 130 until reaching a planar portion, substantially vertical of the rear gutter wall 122. In this embodiment, the gutter 112 is provided essentially in the form of a linear extrusion such that its floor 120 remains within a substantially constant plane along its full lateral length In an alternative embodiment shown in FIG. 7, the support member 280 has a gutter 212 similar in most respects to that discussed above and shown in FIG. 6, except that here the gutter 212 tapers downward as it approaches the lateral end thereof, in order that liquid gathered therein will tend to flow laterally by gravity. Specifically, the gutter floor 220 tapers downwardly as it approaches the respective laterally-outer end 216 of the support member 280, as seen in FIG. 7 (and best seen by comparing FIG. 7 to FIG. 6). Optionally, the downward slope in the rearward direction of gutter floor 220 also can be more pronounced than in the embodiment of FIG. 6, such that liquid is caused more strongly to flow both rearward and laterally once it is captured within the gutter 212. And in even other embodiments, varying degrees of lateral taper can be present over an entire lateral length of, or a portion of, the respective gutter floor.

Returning again to FIGS. 3 and 4, the alignment of the support member 80 relative to each of the control housing 42 and the cooktop 48 will be detailed. When aligned relative to the cooktop 48, the control housing 42 and chassis 15, the support member 80 is disposed in the vicinity of the gap 74 between the front edge 59 of the cooktop 48 and the rear edge 70 of the control housing 42, such that the upper support flange 92 of the support member 80 is disposed generally beneath and adapted to support the underside of the wall defining the top surface 64 of the control housing 42.

The alignment of the support member 80 relative to the cooktop 48 and to the control housing 42 can be provided by the cross member 84 being fastened to a front-facing face 130 of the chassis 15 or of the cooktop 48 by suitable fasteners disposed through the mounting holes 91. The lower mounting flanges 82 are fastened to the upper portion of the chassis 15 by suitable fasteners disposed through the mounting holes 108. By this alignment, the upper support flange 92 extends forward towards a front of the respective cooking appliance 10. The mounting flanges 82 extend rearwardly towards the cooktop 48. However, in other embodiments, one or more mounting flanges 82 can extend to the side or to the front of the cooking appliance 10. One or more additional mounting flanges 82 could be included and/or the depicted mounting flanges 82 could be connected to or integral with one another, such as along the chassis 15 and generally parallel to the cross member 84.

The upper support flange 92 is shaped to define an upper mounting surface having a substantially full-width (extending laterally between opposite sides of the cooking appliance 10) relative to the upper portion of the control housing 42 seated on the upper support flange 92. The curvature of the upper support flange 92, which is substantially horizontal at its forward-facing distal edge 132, but then curves downward as extends in a rearward direction from that edge 132, collects and guides spilled liquids through the gap 74 above, and redirects them into the gutter 112 as will be appreciated. The control panel 40 is located in the control housing below the distal end 132. In some embodiments, the control housing 42 can be coupled to the upper support flange 92.

The side flanges 100 extend forward, towards a front of the cooking appliance 10. The side flanges 100 aid in locating and centering the control housing 42 relative to the cooktop 48 and the chassis 15. For example, the side flanges 100 and the upper support flange 92 serve as guides for the support member, which can aid in facilitating rapid or even automated assembly. In some embodiments, the control housing 42 can be coupled to one or both of the side flanges 100. And similar to the mounting flanges 82, one or more additional side flanges 100 could be included extending forward or rearward relative to the front and rear of the cooking appliance 10.

When the support member 80, control housing 42 and cooktop 48 all are installed at the appliance 10 relative to one another, the support member 80 is hidden from view of a user viewing the cooktop 48, with only the gap 74 allowing for minimal fluid communication therewith from the outside. Particularly, one or both of the upper support flange 92 and the gutter 112 are disposed directly below the gap 74, to be further detailed.

Preferably, the gap 74 has a substantially constant thickness along its length, between the forward edge 59 of the cooktop and the rear edge 70 of the control housing 42. The thickness of the gap 74 preferably is less than half of a channel width of the channel 114 of gutter 112.

In use, spills or liquids collected at the cooktop surface 50, which may otherwise flow towards the control housing 42 and electronic elements disposed therein, penetrate the gap 74. As shown best at FIG. 4, when liquids penetrate that gap 74 they first encounter the upper support flange 92 just beneath an upper portion 134 of the control housing 42. Liquid arriving at that upper flange 92 is caused by its curvature to flow rearwardly toward and into the gutter 112, thus being redirected away from sensitive electronics, such as the control panel 40, located more forward within the control housing 42. In this way, the support member 80 limits or altogether prevents spills that penetrate the gap 74 from contacting sensitive electronics, instead redirecting those spills into the gutter 112 where they can be channeled away. Once in the gutter 112, the liquid can be redirected laterally outward and away from sensitive electronics.

For example, a conduit opening can be disposed adjacent a gutter end 115. In other embodiments a hole can be provided at the gutter floor 120 for allowing liquids to flow to a collection conduit (not shown). And as mentioned above, the gutter floor 120 can be slanted in any suitable manner to aid in directing liquids in the gutter 112.

In other embodiments, the upper support flange 92 can be disposed fully forwardly of the gap 74, rather than vertically beneath the gap 74. In such case, the gutter 112, and particularly the gutter can be disposed vertically below the gap 74 such that spilled liquids that penetrate the gap 74 enter the gutter 112 directly.

The disclosed support member 80 provides numerous benefits over conventional use of a pliable interface or arrangement of a front edge of the cooktop surface below a rear edge of the control housing. As shown at least at FIGS. 3 and 4, use of the support member 80 and integral gutter 112 allows abutting surface contact between the control housing 42 and the cooktop 48, yielding a substantially co-planner arrangement, that still does not materially risk spilled liquids penetrating the control housing 42 to damage enclosed electronic components. Additionally, the uppermost surface 64 of the control housing 42 is able to be disposed adjacent and at a common elevation with the uppermost cooking surface 50 of the cooktop 48, providing am aesthetically pleasing surface-planar abutment. The support member 80 also yields landmarks 92, 100 and attachment points 82, 84 for assembly and attachment of the control housing 42 relative to the cooktop 48 and relative to the chassis 15, thus facilitating rapid or even automated assembly.

Figure 8:
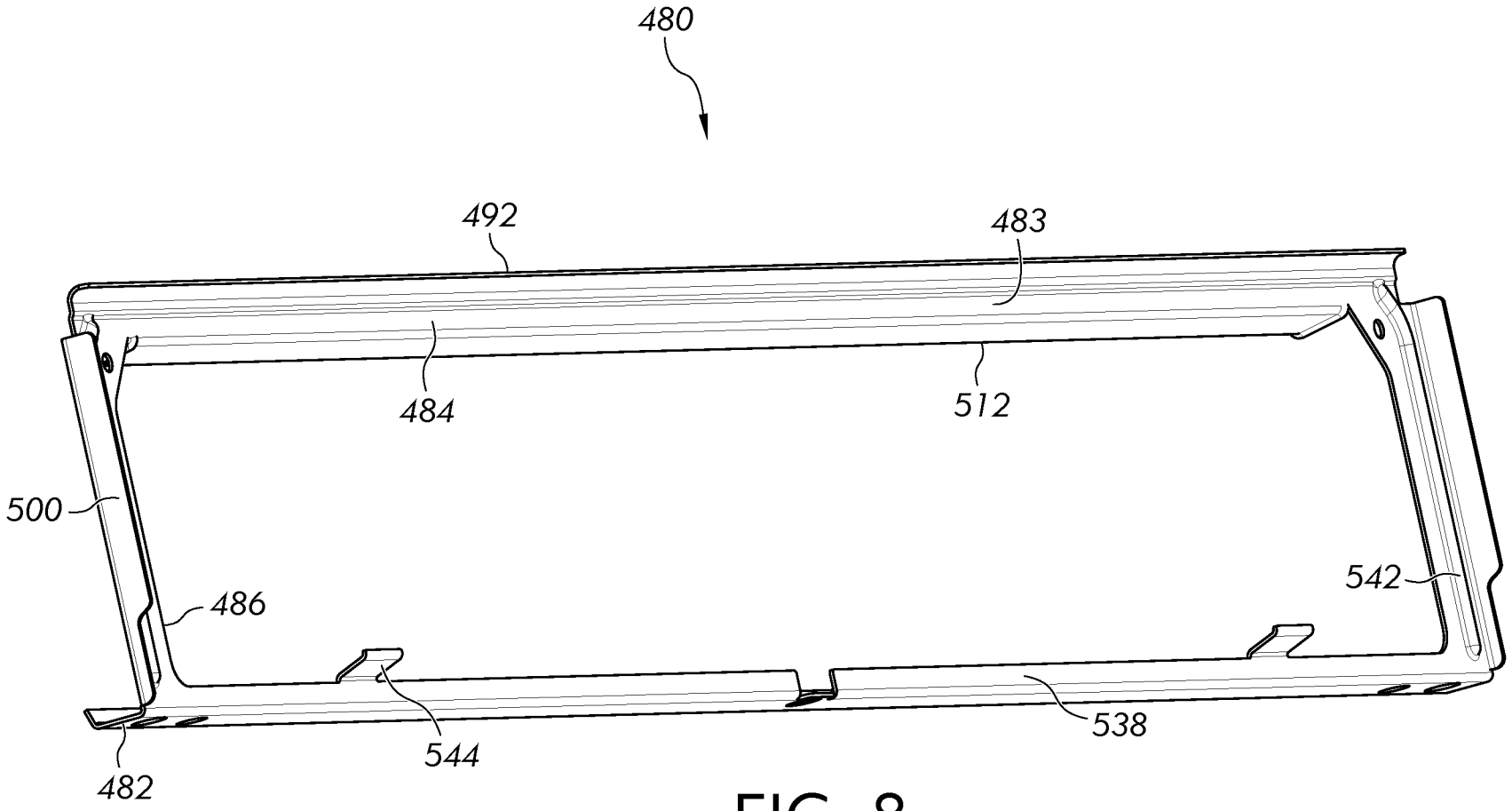
FIG. 8 illustrates a first front perspective view of yet another example support member of FIG. 8.
Figure 9:
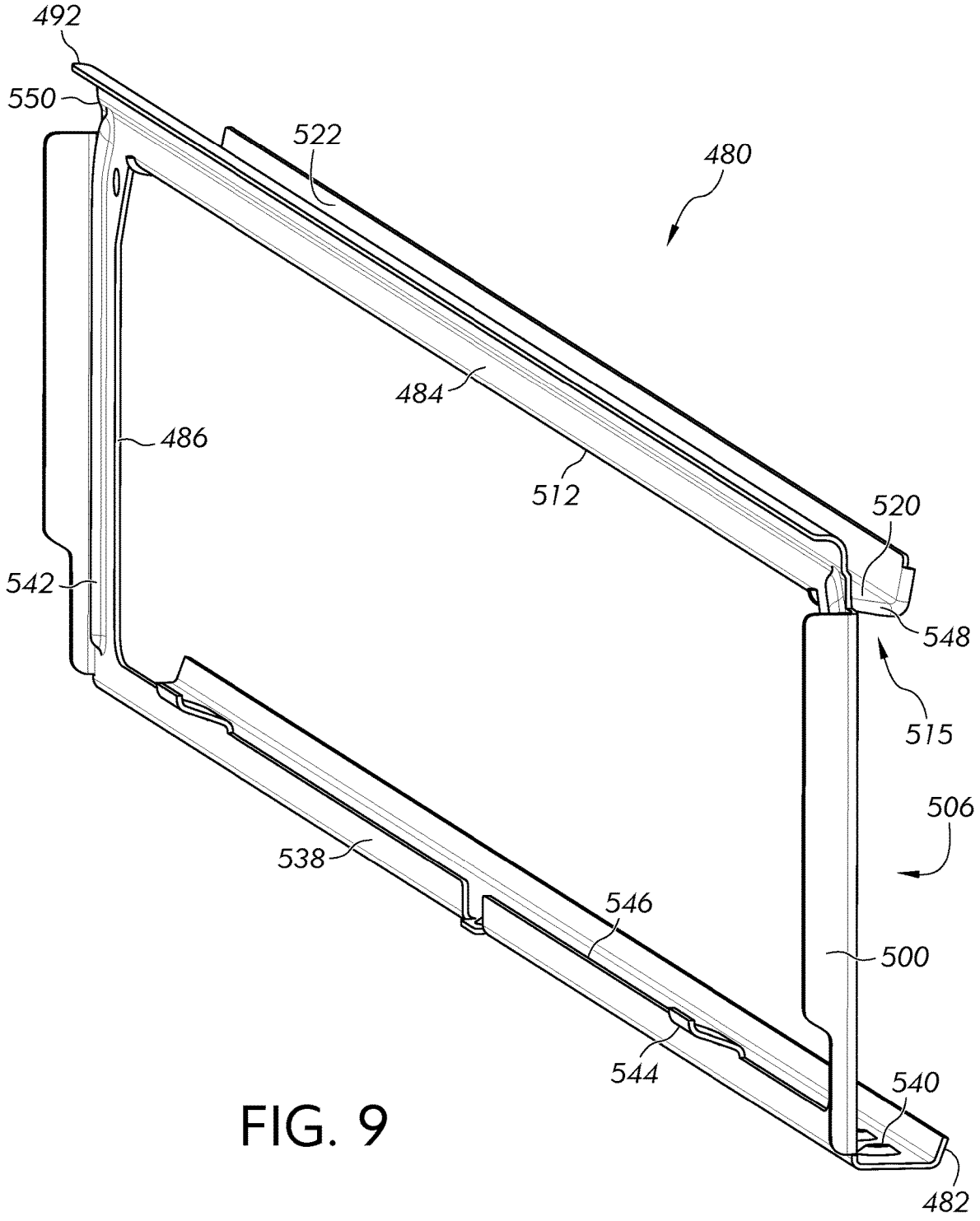
FIG. 9 illustrates a second front perspective view of the support member of FIG. 8.
Figure 10:
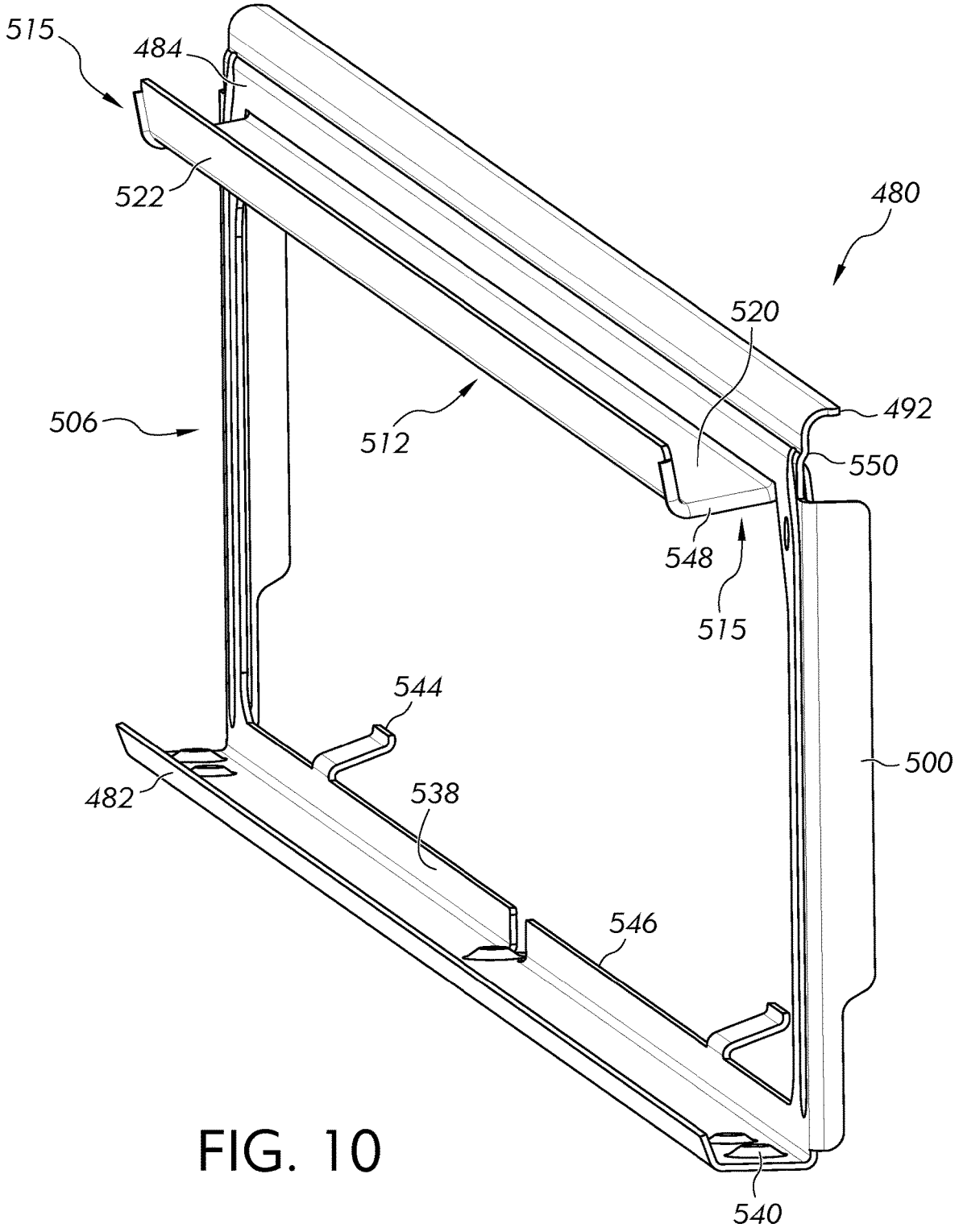
FIG. 10 illustrates a rear perspective view of the support member of FIG. 8.

Turning next to FIGS. 8 to 10, an alternate embodiment of a support member is depicted. The depicted support member 480 is substantially similar to the support member 80 discussed above except as discussed below. Aspects of the support member 480 that are similar to aspects of the support member 80 are identified with the same reference numbers but indexed by 400. It will be appreciated that aspects of the support members 80, 480 can be incorporated into one another.

Referring to FIGS. 8 to 10, the support member 480 is depicted in isolation from the control housing 42 and the cooktop 48. The support member 480 is configured to be aligned between the cooktop 48 and the control housing 42, and to support the control housing 42 similarly to the support member 80. The principal difference is that support member 480 includes a lower mounting flange 482 that extends laterally between the legs 486 and side flanges 500.

As seen there, the lower mounting flange 482 extends rearward, opposite the direction of the side flanges 500, from a lower cross member 538. The lower cross member 538 extends generally parallel to the upper cross member 484 between the pair of legs 486. A plurality of ribs 540 are stamped into the lower mounting flange 482 and extend vertically. Similarly, a vertically-extending rib 542 is stamped into the rear face 506 along each of the legs 486.

Together, the ribs 542, ribs 540, lower cross member 538 and laterally-extending mounting flange 482 provide increased rigidity to the support member 480 as compared to the support member 80 (FIG. 5). This additional rigidity can aid in supporting a control housing 42 having numerous electronic controls attached thereto. The additional rigidity also can aid in resisting deformation from impact during manufacturing of the cooking appliance 10, or transport for sale.

Turning specifically to FIG. 10, the support member 480 also includes additional features at a vertically-upper end thereof that provide further rigidity to the main body 483. For example, a lateral fold-over flange 548 is disposed at each of the lateral gutter ends 515 of the gutter 512, essentially as folded sheet metal extending from the lateral ends of the gutter floor 520 and the rear gutter wall 522 at each end. These lateral fold-over flanges 548 can provide additional rigidity and/or provide a lead-in to direct fluids flowing out of the gutter 512.

The upper support flange 492 includes a laterally-extending rib 550, as compared to the support flange 92 (FIG. 5), to provide additional support for downwardly applied force from the control housing 42 when seated on the support flange 492.

Additionally, a pair of discrete service tabs 544 are bent and extend forward (cantilevered) from a vertically upper edge 546 of the lower cross member 538, in a similar direction as the side flange 500. The service tabs 544 facilitate efficient service of the electronic components of the control housing 42 by facilitating a fold-down manner of accessing them from the front of the appliance. Specifically, tabs 544 can cooperate with structure at the front of the chassis to hold the support member in position folded downward toward the front of the appliance (e.g. facing the floor), thereby providing access to the control-housing 42 electronics. This can be useful because those electronics typically are connected to the appliance via lead wires with short lengths. So using the support member 80 to facilitate in-place servicing and easy access is useful.

In summary, a household appliance, such as a cooking appliance 10, is provided having a cooktop 48 with a control housing 42 disposed at an outer peripheral edge of the cooktop 48. A control panel 40 of the control housing 42 is configured to allow a user to control the cooktop 48 and is least partially housed within the control housing 42. A support member 80, 280, 480 is interposed at least partially between the cooktop 48 and the control housing 42 and includes a gutter 112, 212, 512 adapted to direct fluids from the cooktop 48 in a direction away from electrical or electronic elements housed within the control housing 42, such as the control panel 40. The support member 80, 280, 480 can be coupled to or otherwise support the control housing 42, e.g. to assure appropriate alignment thereof, e.g. for automated assembly. The support member 80, 280, 480 further can be hidden from view of a user beneath respective upper surfaces 50, 64 of the control housing 42 and the cooktop 48, allowing these upper surfaces 50, 64 to lie in a common plane, providing a desirable aesthetic for the user.

The invention has been described with reference to the example embodiments described above. Modifications and alterations will occur to others upon a reading and understanding of this specification. Example embodiments incorporating one or more aspects of the invention are intended to include all such modifications and alterations insofar as they come within the scope of the appended claims and their equivalents.

What is claimed is:

1. A cooking appliance, comprising:

a cooktop;

a control housing disposed adjacent to the cooktop and housing an electronic control; and a support member interposed at least partially between the cooktop and the control housing and having a gutter adapted to direct fluids from the cooktop away from the electronic control, wherein the control housing is aligned relative to the cooktop via a plurality of guides of the support member, the support member further comprising an upper support flange disposed below and supporting an upper wall of the control housing.

2. The cooking appliance of claim 1, wherein the support member further includes a cross member, the gutter depending or formed integrally with said cross member and extending rearward relative thereto.

3. The cooking appliance of claim 1, wherein the gutter extends substantially continuously along a full length of the support member between lateral side ends of the support member.

4. The cooking appliance of claim 1, said upper support flange having a downward slope in a rearward direction relative to the appliance, such that liquids caught by said upper support flange will be redirected by gravity toward said gutter.

5. The cooking appliance of claim 4, said upper support flange being curved such that said downward slope becomes greater in a rearward direction toward said gutter.

6. The cooking appliance of claim 1, wherein the gutter is disposed vertically below the upper support flange.

7. The cooking appliance of claim 1, said gutter having a gutter floor that tapers downward on approaching a lateral end of said gutter.

8. The cooking appliance of claim 1, wherein the support member is coupled to the control housing to thereby support the upper wall of the control housing such that an upper surface of the control housing is substantially coplanar with and adjacent to an upper surface of the cooktop, and defining a gap therebetween.

9. The cooking appliance of claim 1, said support member further comprising a gutter aligned with respect to said gap such that liquids that penetrate said gap are captured by said gutter and redirected thereby away from said electronic control within said control housing.

10. A cooking appliance, comprising:

a cooktop having a cooktop surface;

a control housing disposed adjacent to the cooktop and housing one or more electronic controls, such that said cooktop surface is substantially coplanar with an upper surface of said control housing and defines a gap therebetween; and a support member configured to redirect fluids penetrating said gap from the cooktop away from the one or more electronic controls, the support member being interposed at least partially between the cooktop and the control housing and supporting the control housing to align the upper surface of the control housing in substantially the same plane as the cooktop surface.

11. The cooking appliance of claim 10, wherein the support member comprises a gutter for collecting fluid penetrating said gap.

12. The cooking appliance of claim 11, wherein the one or more electronic controls include a control panel disposed at least partially within the control housing and configured to allow a user to control the cooktop, wherein the control panel is disposed at a side of the support member opposite the gutter.

13. The cooking appliance of claim 10, wherein the gap has a substantially constant thickness between respective edges of the cooktop surface and the upper surface of the control housing, and wherein the thickness of the gap is less than half of a channel width of a channel defined by the gutter.

14. A support member for supporting a control housing of a cooking appliance adjacent to a cooktop of the cooking appliance, the support member, comprising:

a cross member;

a pair of legs extending vertically from opposite ends of the cross member;

a gutter extending along the cross member at a first side thereof; and an upper support flange extending from a second side of the cross member opposite the first side thereof, the upper support flange configured to support an upper wall of a control housing in order to align and install said control housing to said appliance, wherein the gutter defines a channel for receiving fluid therein and for diverting said fluid laterally outwardly in said channel.

15. The support member of claim 14, further including a lower mounting flange extending from a distal end of each said leg, each said lower mounting flange being configured for coupling to the cooking appliance.

16. The support member of claim 14, wherein the gutter is disposed vertically below the upper support flange.

17. The support member of claim 14, said upper support flange having a downward slope in a rearward direction towards the gutter, such that liquids caught by said upper support flange will be redirected by gravity toward said gutter.

18. The support member of claim 14, said gutter having a gutter floor that tapers downward on approaching a lateral end of said gutter.

19. The support member of claim 14, further including another cross member disposed vertically below the cross member and extending between the pair of legs.

* * * * *